US009742052B2

(12) United States Patent
Hasch et al.

(10) Patent No.: US 9,742,052 B2
(45) Date of Patent: Aug. 22, 2017

(54) DEVICE FOR TRANSMITTING BETWEEN A MICROSTRIP ON A CIRCUIT BOARD AND A WAVEGUIDE USING A SIGNAL LINE DISPOSED WITHIN A HOUSING THAT IS SOLDERED TO THE CIRCUIT BOARD

(71) Applicant: Robert Bosch GmbH, Stuttgart (DE)

(72) Inventors: Juergen Hasch, Stuttgart (DE); Elena Pancera, Leonberg (DE); Carsten Potratz, Gerlingen (DE); Dirk Schmidt, Kirchheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 75 days.

(21) Appl. No.: 14/851,823

(22) Filed: Sep. 11, 2015

(65) Prior Publication Data

US 2016/0079647 A1 Mar. 17, 2016

(30) Foreign Application Priority Data

Sep. 12, 2014 (DE) ..... 10 2014 218 339

(51) Int. Cl.
*H01P 5/107* (2006.01)

(52) U.S. Cl.
CPC ..... *H01P 5/107* (2013.01)

(58) Field of Classification Search
CPC ..... H01P 5/107; H01P 5/103
USPC ..... 333/26
See application file for complete search history.

(56) References Cited

U.S. PATENT DOCUMENTS

| | | | | |
|---|---|---|---|---|
| 4,716,387 | A * | 12/1987 | Igarashi | H01P 5/107 333/208 |
| 4,725,793 | A * | 2/1988 | Igarashi | H01P 5/107 333/208 |
| 6,265,950 | B1 * | 7/2001 | Schmidt et al. | H01P 5/107 333/26 |
| 2004/0263277 | A1 * | 12/2004 | Ding et al. | H01P 5/107 333/21 R |
| 2005/0099242 | A1 * | 5/2005 | Sano | H01P 5/107 333/26 |
| 2006/0181365 | A1 * | 8/2006 | Baird | H01P 5/107 333/26 |

* cited by examiner

*Primary Examiner* — Benny Lee
(74) *Attorney, Agent, or Firm* — Norton Rose Fulbright US LLP; Gerard Messina

(57) ABSTRACT

A device for transmitting millimeter-wave signals between a microstrip formed on a circuit board and a waveguide, characterized by a housing which is soldered onto the circuit board with the aid of solder contacts and which contains a signal line, which is connected to the microstrip via a soldered connection suitable for use at high frequencies, and which connects this microstrip to a coupling point for the millimeter-wave signals, the coupling point facing the waveguide.

18 Claims, 1 Drawing Sheet

DEVICE FOR TRANSMITTING BETWEEN A MICROSTRIP ON A CIRCUIT BOARD AND A WAVEGUIDE USING A SIGNAL LINE DISPOSED WITHIN A HOUSING THAT IS SOLDERED TO THE CIRCUIT BOARD

FIELD OF THE INVENTION

The present invention relates to a device for transmitting millimeter-wave signals between a microstrip formed on a circuit board and a waveguide.

BACKGROUND INFORMATION

Integrated semiconductor components, so-called MMICs (Monolithic Microwave Integrated Circuits), are often used to generate millimeter-wave signals, e.g., in radar sensors for motor vehicles, the integrated semiconductor components being encapsulated in a housing suitable for surface mounting, e.g., an eWLB housing (embedded Wafer Level Ball Grid), and being soldered onto a circuit board. Microstrips formed on the circuit board may be used to transmit the millimeter-wave signals to an antenna and to transmit the radio echoes received from the antenna to a high frequency component (MMIC) which evaluates the signals. This type of signal transmission is preferable, in particular, even if the antenna elements are formed by patch antennas on the circuit board.

On the other hand, it is also known, however, to transmit the millimeter-wave signals with the aid of so-called waveguides. These are channel-like hollow structures, the walls of which are made conductive by plating or by coating with an electrically conductive plastic, and which therefore form a resonance chamber in which certain vibrational modes of the electromagnetic waves (millimeter waves) may propagate.

When the electrically conductive wall of the waveguide is interrupted or perforated at a point, energy may be radiated out of the waveguide or radiated into this waveguide at this point. High-performance antennas may be implemented by designing hollow-conductor structures of this type in a skillful manner.

When antennas of this type are intended for use in a radar sensor, it is necessary, however, to transmit the millimeter-wave signals from the microstrip on the circuit board to the waveguide or in the opposite direction from the waveguide to the microstrip. Various transitions and coupling structures may theoretically be used for this purpose, although the structures previously known are unsuitable for use in mass production of large quantities due to their complexity.

SUMMARY OF THE INVENTION

An object of the present invention, therefore, is to create a device for transmitting millimeter-wave signals which is better suited for mass production.

This object is achieved according to the present invention by a housing which is soldered onto the circuit board with the aid of solder balls and which contains a signal line, which is connected to the microstrip via a solder connection suitable for use at high frequencies, the signal line connecting the microstrip to a coupling point for the millimeter-wave signals, the coupling point facing the waveguide.

According to the present invention, a housing of the type that has been previously used to accommodate and contact the MMICs is therefore used as a relay between the microstrip and the waveguide. Instead of an MIMIC (or in addition thereto), the housing contains an internal signal line, one end of which is connected to the microstrip of the circuit board via the soldered connection, and the internal signal line extends to a coupling point formed in the wall of the housing which is diametrically opposed to an open end of the waveguide, so that the millimeter waves are decoupled from the housing and are injected into the waveguide, or vice versa.

Mature manufacturing technologies which have previously been used for manufacturing and encapsulating MMICs may also be used to manufacture the housing including the coupling point and the internal signal line. All that is left to do in order to establish contact to the microstrip on the circuit board is to then solder the housing, which has already been connected to the waveguide, onto the circuit board, for which economical assembly methods (SMD—Surface Mount Device technology) are also available for this purpose.

The housing may be, e.g., a known eWLB housing. The signal line in the interior of the housing may in turn be a microstrip.

If necessary, the signal line may also interconnect coupling points for multiple waveguides, so that the millimeter-wave energy fed from the circuit board may be distributed to multiple waveguides and, therefore, to multiple antennas.

DETAILED DESCRIPTION OF EXAMPLE EMBODIMENTS

Figure 1:
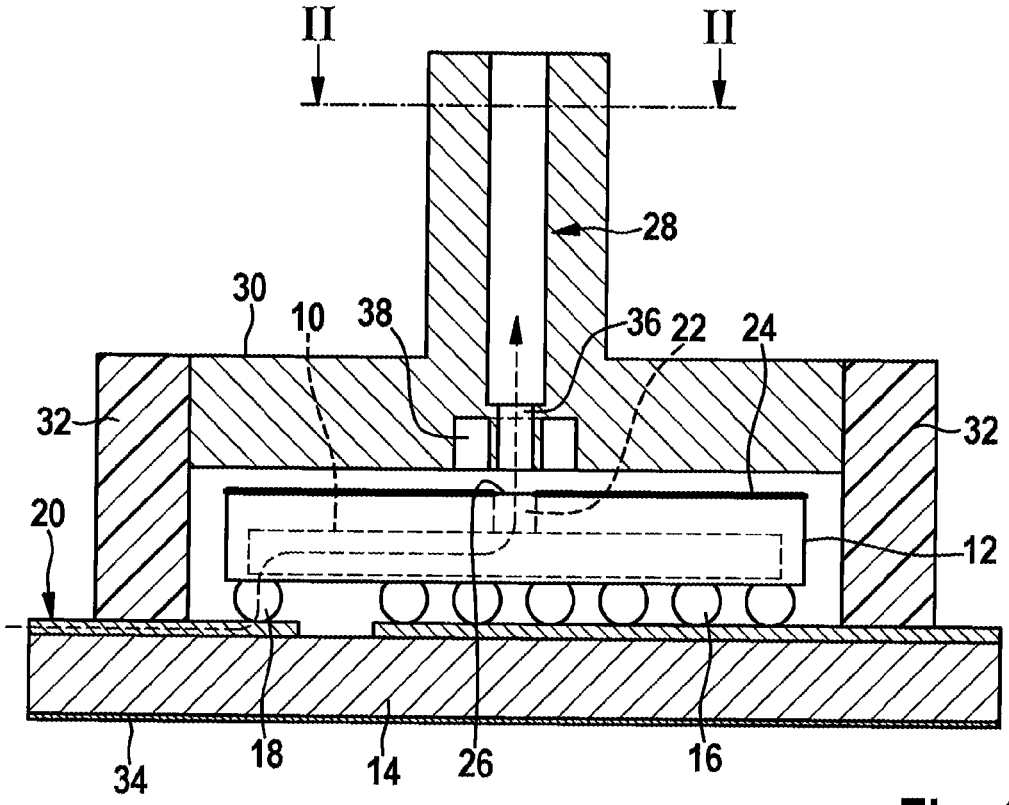
FIG. 1 shows a schematic section through a transmission device according to the present invention.

The transmission device for millimeter-wave signals shown in FIG. 1 includes a signal line 10, e.g., a microstrip, which is encapsulated in a housing 12, e.g., an eWLB housing, exclusively or together with other high-frequency components. Housing 12 is fastened and contacted on the surface of a circuit board 14 using SMD (Surface Mounted Device) technology and, for this purpose, has a grid-shaped system of spherical solder contacts 16, 18 in a housing wall facing circuit board 14. Contacts 16 are used to mechanically fasten housing 12 and, if necessary, to transmit supply voltages and/or low-frequency control signals for electronic components which might be accommodated in housing 12 in addition to signal line 10. Contacts 18 are suitable for use at high frequencies and connect one end of signal line 10 to one end of a microstrip 20 which is formed on circuit board 14 and is used to transmit a millimeter-wave signal which is generated, e.g., in an MMIC (not depicted) mounted at another point on circuit board 14.

For injecting or decoupling the millimeter-wave signals, housing 12 has a coupling point 22 on its inner side, which is designed as a waveguide with or without dielectric filling and injects or decouples the millimeter-wave signals through a housing wall facing away from circuit board 14 which, in this case, is the housing wall on the side opposite the circuit board. In the example shown, this housing wall has a plating 24, which is interrupted by windows 26 where coupling point 22 is located. The millimeter-wave signals may therefore be injected into or decoupled from a waveguide 28 through windows 26, the waveguide extending outside of housing 12 perpendicular to the plated housing wall. In this way, a signal path is formed on which the millimeter-wave signals may be transmitted, e.g., from microstrip 20 to waveguide 28, as indicated in FIG. 1 by a dashed arrow.

In the example shown, waveguide 28 is formed in a hood 30 which is made of material having good conductivity, or at least has an inner surface which is conductive, e.g., is coated with conductive plastic, and forms a cover for housing 12. Hood 30 is bonded onto circuit board 14, e.g., with non-conductive supports 32.

On the underside of the circuit board 14, a conductive layer 34 is formed which is at ground potential. As an option, the conductive inner walls of waveguide 28 may be grounded via a conductive connection to layer 34, although such a grounding is not absolutely necessary.

In the example shown, an fitting structure 36 is formed at the end of waveguide 28, the fitting structure being formed by a suitably shaped hollow space in the wall of hood 30 and is used to minimize the transmission losses in the transition from coupling point 22 to waveguide 28. Waveguide 28 axially adjoins fitting structure 36 and may have a rectangular cross section with the dimensions 2.54 mm×1.27 mm (WR-10 standard). As an option, the waveguide may also contain a dielectric material.

Waveguide 28 shown in FIG. 1 may transition, outside of hood 30, into a connecting waveguide (not depicted), via which the millimeter-wave signals are distributed, e.g., to antennas of a radar sensor. As an option, other waveguides in addition to waveguide 28 may also be connected to signal line 10 in a corresponding manner.

In the example shown, fitting structure 36 is surrounded by a wave trap 38 in the form of a rectangular trench. Wave trap 38 prevents electromagnetic stray fields, which may occur in conjunction with the transmission of the millimeter waves between coupling point 22 and waveguide 28, from propagating in the intermediate space between housing 12 and hood 30, so that the electromagnetic stray fields may be received by fitting structure 36. The insertion loss is thereby diminished and, when housing 12 has multiple coupling points for multiple waveguides, the insulation between the coupling points is simultaneously improved, so that the signals may be injected and decoupled, independently of one another, via the various coupling points.

Figure 2:
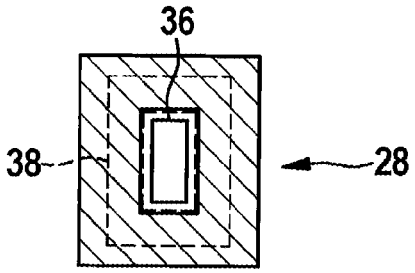
FIG. 2 shows a section along the line II-II in FIG. 1.

FIG. 2 shows a section along line II-II of FIG. 1. FIG. 2 shows waveguide 28, wave trap 38 and fitting structure 36 also shown in FIG. 1.

What is claimed is:

1. A device for transmitting a millimeter-wave signal between a microstrip formed on a circuit board and a waveguide, comprising:

a housing soldered onto the circuit board with the aid of spherical solder contacts on a surface of the housing, the housing encapsulating a signal line that is connected to the microstrip via a soldered connection suitable for use at high frequencies, and the signal line connecting the microstrip to a coupling point for the millimeter-wave signal, wherein the coupling point faces the waveguide.

2. The device as recited in claim 1, wherein the signal line is a microstrip.

3. The device as recited in claim 1, wherein the spherical solder contacts are in a grid on the surface of the housing.

4. The device as recited in claim 1, wherein the soldered connection is via a first spherical solder contact of the spherical solder contacts.

5. The device as recited in claim 1, wherein the coupling point is a first waveguide in the housing, the first waveguide for injecting or decoupling the millimeter-wave signal through the housing.

6. The device as recited in claim 5, further comprising:

a hood that covers the housing, the hood including a second waveguide, the first waveguide injecting into or decoupling from the second waveguide the millimeter-wave signal.

7. The device as recited in claim 6, wherein the hood is bonded to the circuit board.

8. The device as recited in claim 6, wherein the hood includes a wave trap surrounding the second waveguide.

9. A device for transmitting a millimeter-wave signal between a microstrip formed on a circuit board and a wave guide, comprising:

a housing soldered onto the circuit board with the aid of solder contacts, the housing including a signal line that is connected to the microstrip via a soldered connection suitable for use at high frequencies, the signal line connecting the microstrip to a coupling point for the millimeter-wave signal, wherein the coupling point faces the waveguide;

wherein the housing is an embedded Wafer Level Ball Grid ("eWLB") housing, the housing encapsulating the signal line, and the solder contacts including a grid of spherical solder balls on a surface of the housing.

10. A device for transmitting a millimeter-wave signal, comprising:

a housing encapsulating a signal line, the signal line suitable for transmitting the millimeter-wave signal, the housing including a plurality of solder contacts on a first surface for surface mounting the housing on a circuit board, the signal line situated in the housing so that the signal line connects to a microstrip on the circuit board when the housing is mounted on the circuit board; and a first waveguide in the housing and coupled to the signal line, the waveguide designed to inject or decouple the millimeter-wave signal through a second surface of the housing, the second surface being opposite to the first surface.

11. The device as recited in claim 10, wherein the signal line is a second microstrip.

12. The device as recited in claim 10, wherein the signal line connects to the microstrip on the circuit board via a first solder contact of the plurality of solder contacts, the first solder contact being suitable for use at high frequencies.

13. The device as recited in claim 10, wherein the plurality of solder contacts is a ball grid array.

14. The device as recited in claim 10, wherein the first waveguide includes a window at the second surface of the housing.

15. The device as recited in claim 10, wherein the signal line and the first waveguide, together, transmit the millimeter-wave signal from or to the microstrip on the circuit board through the housing when the housing is mounted on the circuit board.

16. The device as recited in claim 10, further comprising:

a hood to cover the housing, the hood including a second waveguide, the hood being designed to mount on the circuit board, wherein the first waveguide face the second waveguide when the hood and the housing are mounted to the circuit board.

17. The device as recited in claim 16, wherein the hood includes a wave trap surrounding the waveguide.

18. A method of forming a device for transmitting a millimeter-wave signal, the method comprising:

surface mounting a housing on a circuit board via a ball grid array on a first surface of the housing, the circuit board having a microstrip for transmitting a millimeter-wave signal, the housing encapsulating a signal line and including a first waveguide coupled to the signal line, the signal line connecting the microstrip to the first waveguide when the housing is mounted on the circuit board, the first waveguide designed to inject or decouple the millimeter-wave signal through a second surface of the housing, the second surface being opposite to the first surface; and mounting a hood on the circuit board so as to cover the housing, the hood including a second waveguide, the hood being mounted so that the first waveguide faces the second waveguide.

* * * * *